US006791509B2

(12) United States Patent
Noro

(10) Patent No.: US 6,791,509 B2
(45) Date of Patent: Sep. 14, 2004

(54) HELICAL ANTENNA

(75) Inventor: Junichi Noro, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/202,717

(22) Filed: Jul. 25, 2002

(65) Prior Publication Data

US 2003/0020670 A1 Jan. 30, 2003

(30) Foreign Application Priority Data

Jul. 26, 2001 (JP) ..... 2001-225515
Sep. 10, 2001 (JP) ..... 2001-273042

(51) Int. Cl.[7] ..... H01Q 1/36
(52) U.S. Cl. ..... 343/895; 343/700 MS; 343/702
(58) Field of Search ..... 343/700 MS, 702, 343/725, 729, 895, 906, 893

(56) References Cited

U.S. PATENT DOCUMENTS 6,072,441 A * 6/2000 Tanabe ..... 343/895
6,339,408 B1 * 1/2002 Edvardsson et al. ..... 343/895
6,421,029 B1 * 7/2002 Tanabe ..... 343/895

* cited by examiner

*Primary Examiner*—Shih-Chao Chen
(74) *Attorney, Agent, or Firm*—Frishauf, Holtz, Goodman & Chick, P.C.

(57) ABSTRACT

In a helical antenna having an antenna pattern of a helical shape, the antenna pattern extends along a cylindrical body formed by an insulating film member which is rolled into a cylindrical shape. A circuit board is placed opposite to one of axial ends of the cylindrical body. The circuit board is formed with a circuit pattern connected to the antenna pattern by soldering. The cylindrical body has a specific part which is not provided with the antenna pattern and is fixed to the circuit board.

12 Claims, 4 Drawing Sheets

HELICAL ANTENNA

FIELD OF THE INVENTION

This invention relates to a helical antenna which can be used in a digital radio receiver and the like.

BACKGROUND OF THE INVENTION

In recent years, a digital radio receiver for receiving a radio wave from an artificial satellite (which may be called a "satellite wave" hereinafter) or a radio wave from a ground station (which may be called a "ground wave" hereinafter) to listen to digital radio broadcasting has been developed and is about to be put into practical use. The digital radio receiver is mounted on a mobile station such as a vehicle and is adapted to receive a radio wave having a frequency of about 2.3 GHz to listen to the digital radio broadcasting. In other words, the digital radio receiver is a radio receiver capable of listening to mobile broadcasting. It is noted here that the ground wave is a radio wave obtained by slightly shifting the frequency of the satellite wave after it is received by the ground station.

In order to receive the radio wave having the frequency of about 2.3 GHz, it is necessary to mount an antenna at a position outside a vehicle. Such antenna may have various structures, but a stick type is generally used rather than a planar type (or a flat type).

As is well known, an electromagnetic wave emitted into a free space is a transversal wave having an electric field and a magnetic field vibrating in a plane perpendicular to a propagating direction of the wave. The electric field and the magnetic field are variable in intensity within the above-mentioned plane. Such an electromagnetic wave in which the direction of the electric field is not random but constant or varied in some regular way is referred to as a polarized wave. The satellite wave is a circular polarized wave exhibiting circular polarization while the ground wave is a linear polarized wave exhibiting linear polarization.

As one of the stick-type antennas, a helical antenna is known. The helical antenna comprises a hollow or solid cylindrical body and a conductor wire wound around the cylindrical body in a helical shape (or a spiral shape) and can efficiently receive the above-mentioned circular polarized wave. Therefore, the helical antenna is exclusively (or mainly) used to receive the satellite wave.

It is unavoidable for an automobile to vibrate when moving. Therefore, the helical antenna to be mounted on the automobile must be provided with a sufficient anti-vibration measure. It is needless to say that the helical antenna is required to be excellent in durability.

SUMMARY OF THE INVENTION

It is therefore an object of this invention to provide a helical antenna which is excellent in vibration resistance and which is improved in durability.

It is another object of this invention to provide a helical antenna which is improved in workability in an assembling operation.

Other objects of the present invention will become clear as the description proceeds.

According to the present invention, there is provided a helical antenna which comprises a cylindrical body formed by an insulating film member which is rolled into a cylindrical shape, an antenna pattern extending in a helical shape along said cylindrical body, a circuit board opposite to one of the axial ends of the cylindrical body, a circuit pattern formed on the circuit board; a connecting portion connecting the antenna pattern with the circuit pattern by soldering, and a fixed portion fixing the circuit board to a specific part of the cylindrical body, wherein the specific part is not provided with the antenna pattern.

DESCRIPTION OF THE PREFERRED EMBODIMENTS

With reference to FIGS. 1 to 4, description will be made about a helical antenna according to a first embodiment of the present invention.

Figure 1:
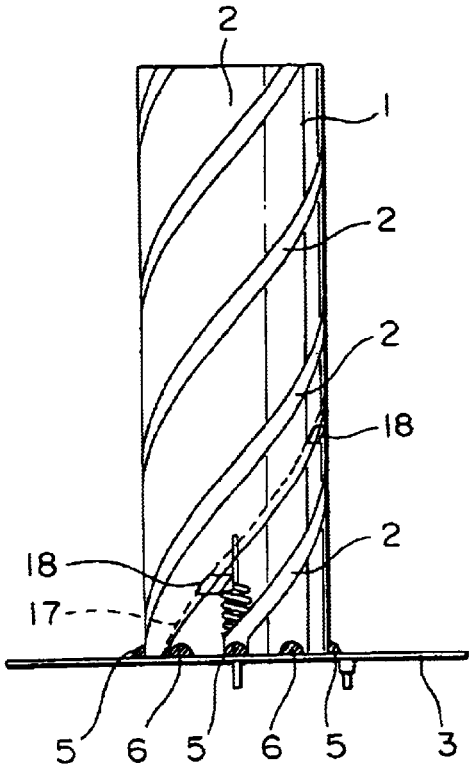
FIG. 1 is a front view of a helical antenna according to a first embodiment of this invention.
Figure 2:
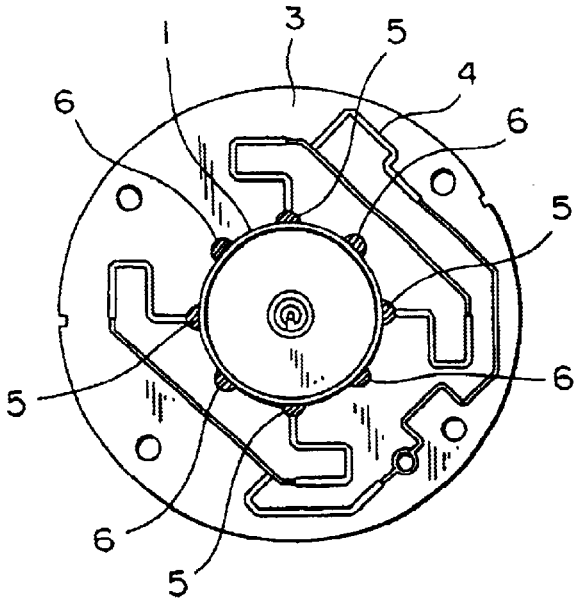
FIG. 2 is plan view of the helical antenna shown in FIG. 1.

The helical antenna shown in FIGS. 1 and 2 comprises a cylindrical body 1 formed by a flexible insulating film member rolled into a cylindrical shape and fixed to keep the cylindrical shape, four antenna patterns 2 each of which comprises a conductor and is formed on the cylindrical body 1 to extend in a helical fashion or shape along its peripheral surface, a circuit board 3 fixed to one of the axial ends of the cylindrical body 1, a circuit pattern 4, such as a phase-shift circuit, formed on the circuit board 3, and four connecting portions 5 through which the antenna patterns 2 are electrically and mechanically connected to the circuit pattern 4 by soldering, respectively.

Between every adjacent two of the four connecting portions 5, one fixing portion 6 is arranged through which the cylindrical body 1 is fixed to the circuit board 3. In other words, each fixed portion 6 fixes a specific part of the cylindrical body 1 which to different from the parts provided with the antenna patterns 2 to the circuit board 3.

Figure 3:
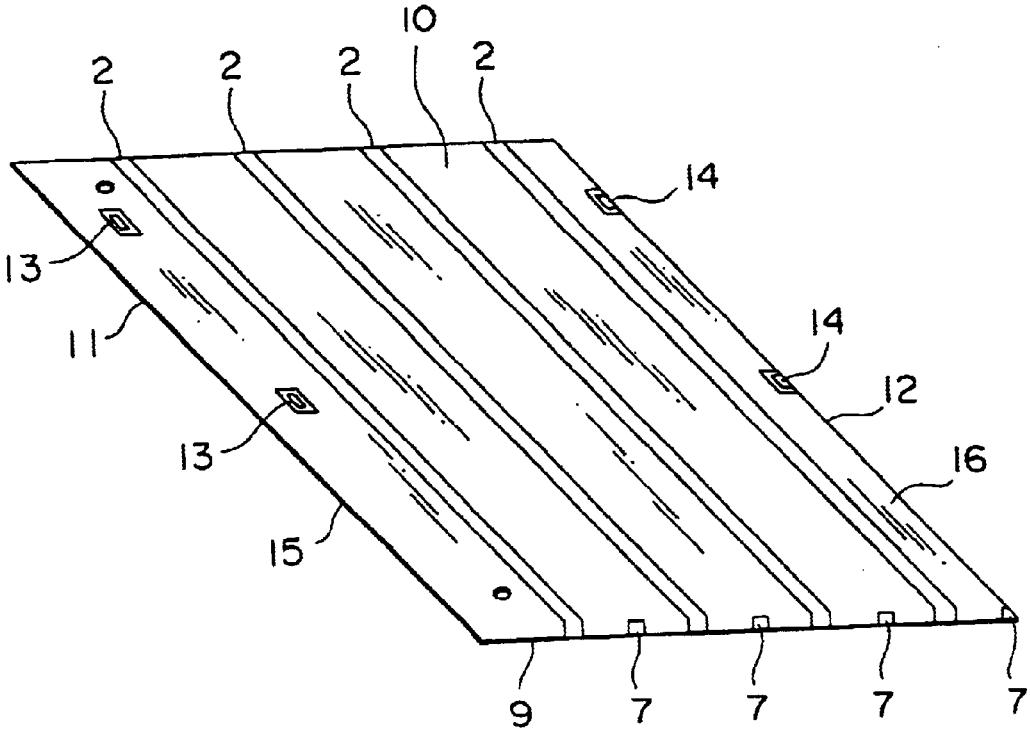
FIG. 3 is a developed view of an antenna element used in the helical antenna shown in FIGS. 1 and 2.
Figure 4:
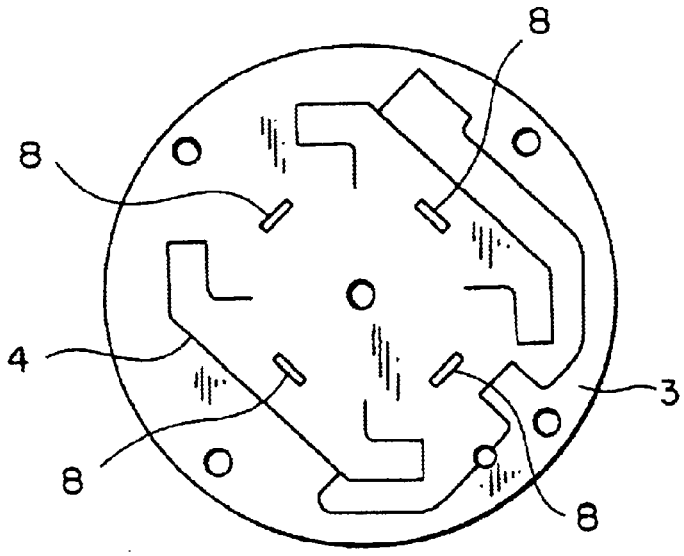
FIG. 4 is a plan view of a circuit board used in the helical antenna shown in FIGS. 1 and 2.

With reference to FIGS. 3 and 4, the description will proceed further.

Each of the fixed portions 6 comprises a metal member 7 formed at the above-mentioned specific part of the cylindrical body 1 and another metal member 8 formed on the circuit board 3 and connected to the metal member 7 by soldering. Consequently, the cylindrical body 1 is fixed to the circuit board 3 at eight positions in total by the four connecting portions 5 and the fixed portions 6 interposed between the connecting portions 5. Thus, the helical antenna mentioned above is excellent in vibration resistance and improved in durability.

The cylindrical body 1 is formed by an insulating film member 10 shown in FIG. 3. The insulating film member 10 has a substantially parallelepiped shape. The insulating film member 10 has one surface provided with four antenna patterns 2 which are formed by etching or the like to extend in parallel to one another with a space kept from one another. Each antenna pattern 2 extends substantially obliquely from a specific side 9 of the insulating film member 10.

The insulating film member 10 has a pair of oblique sides 11 and 12 which are inclined with respect to the specific side 9 and extend in parallel to the antenna patterns 2. In the vicinity of the oblique sides 11 and 12, fixing patterns 13 and 14 made of metal are formed, respectively. These fixing patterns 13 and 14 may be produced simultaneously with and in the manner similar to the antenna patterns 2.

The insulating film member 10 is rolled into the cylindrical shape around a center axis perpendicular to the specific side 9. The insulating film member 10 has opposite end portions 15 and 16 in a circumferential direction. The opposite end portions 15 and 16 are connected to each other to thereby form a film connecting portion. In the film connecting portion, the opposite end portions 15 and 16 of the insulating film member 10 are overlapped with each other to form an overlapping portion. A double-sided adhesive tape 17 is inserted in the overlapping portion to thereby adhere the opposite end portions 15 and 16 to each other. Furthermore, opposite ones of the fixing patterns 13 and 14 are soldered to each other to thereby form a solder connecting portion 18. In this manner, the cylindrical shape of the cylindrical body 1 is fixed and maintained.

Figure 5:
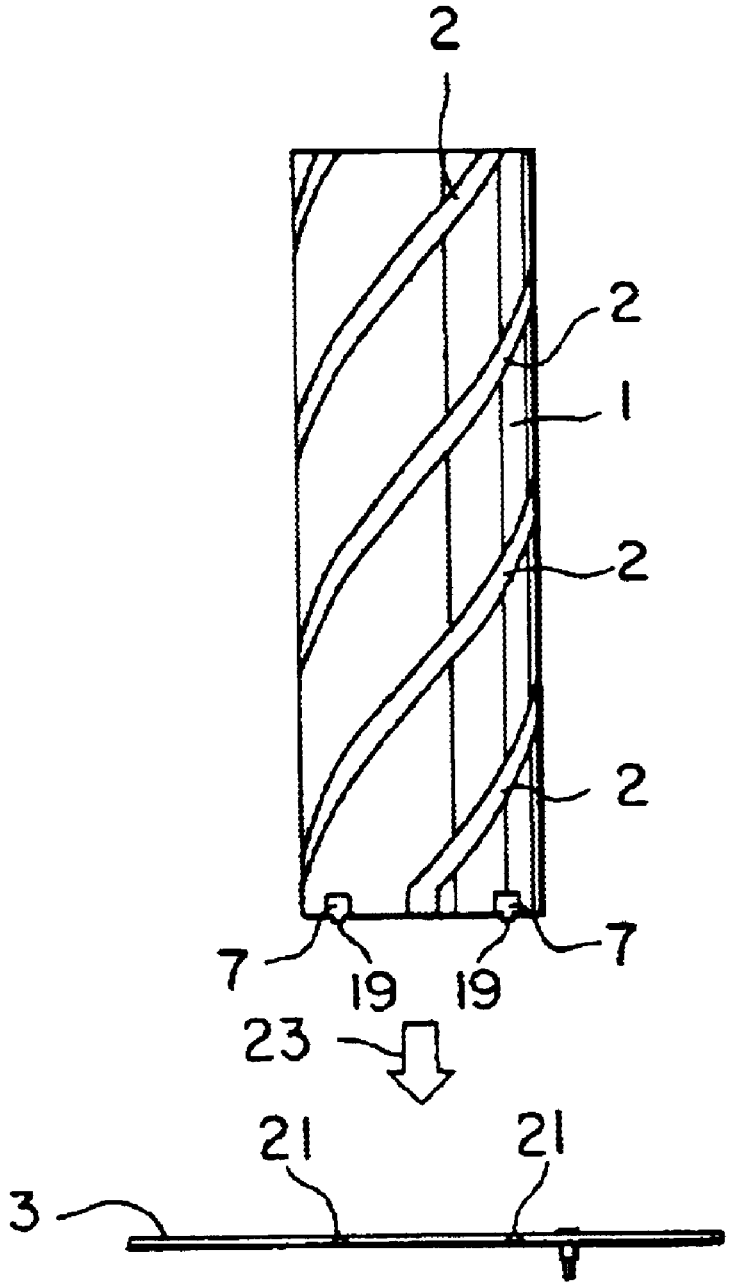
FIG. 5 is a front view for describing an assembling operation of a helical antenna according to a second embodiment of this invention.
Figure 6:
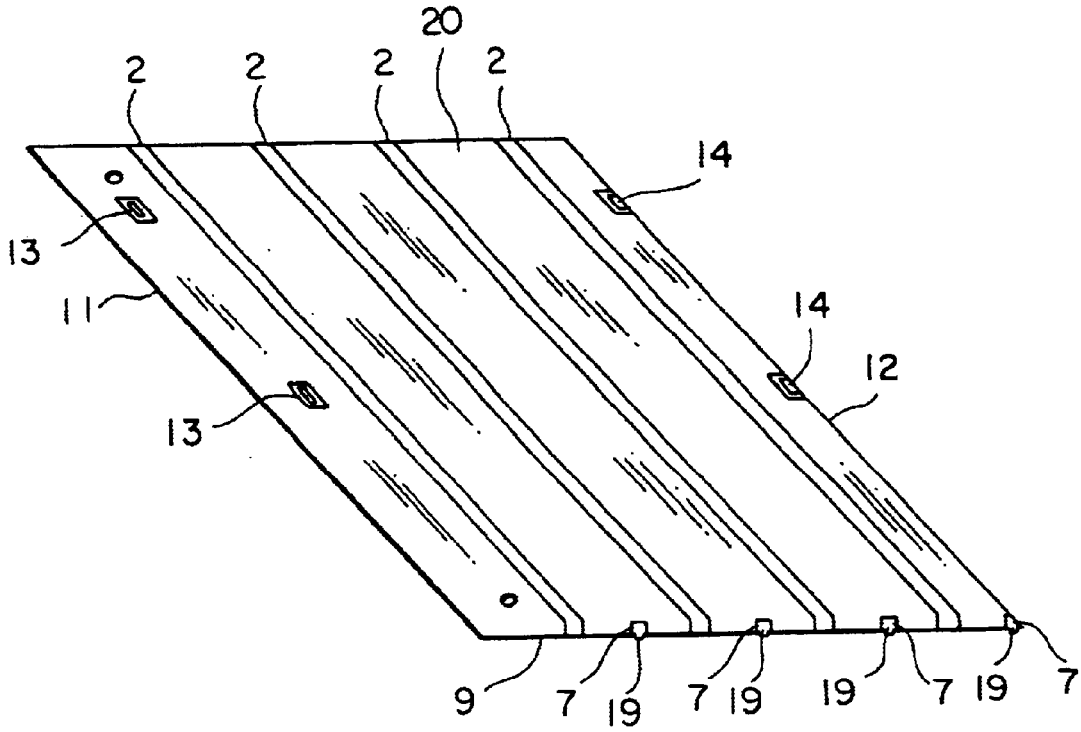
FIG. 6 is a developed view of an antenna element used in the helical antenna shown in FIG. 5.
Figure 7:
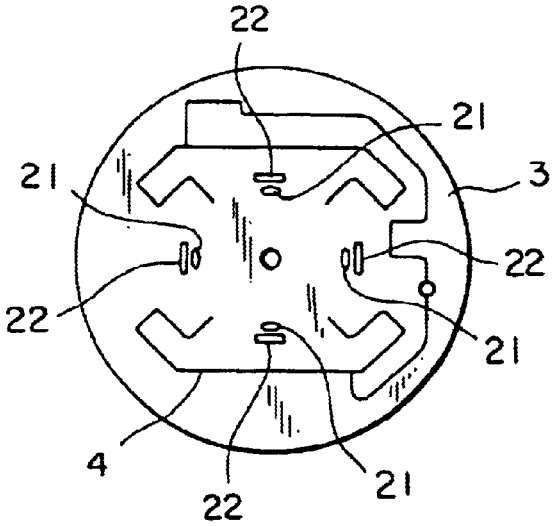
FIG. 7 is a plan view of a circuit board for use in the helical antenna shown in FIG. 5.

With reference to FIGS. 5 to 7, the description will be made about a helical antenna according to a second embodiment of the present invention. Similar parts are designated by like reference numerals and will not be described further.

In FIG. 5, four antenna patterns 2 each comprising a conductor are formed on a cylindrical body 1 to extend in a helical fashion along its peripheral surface. At the one axial end of the cylindrical body 1, a plurality of metal protrusions, that is, positioning tabs 19, are formed at four positions spaced from one another in a circumferential direction of the cylindrical body. Each of the positioning tabs 19 is formed integrally with metal members 7 formed on the above-mentioned specific parts of the cylindrical body 1. On the other hand, a circuit board 3 is provided with engaging holes 21 to be engaged with the positioning tabs 19, respectively.

The cylindrical body 1 is formed by an insulating film member 20 shown in FIG. 6. The insulating film member 20 also has a substantially parallelepiped shape. The insulating film member 20 has one surface provided with the four antenna patterns 2 which are formed by etching or the like to be in parallel to one another with a space kept from one another. Each antenna pattern 2 substantially obliquely extends from a specific side 9 of the insulating film member 20. The metal members 7 and the positioning tabs 19 integral therewith are provided at four positions on the specific side 9 of the film member 20.

The film member 20 is provided with fixing patterns 13 and 14 made of metal and formed in the vicinity of a pair of oblique sides 11 and 12 which are inclined with respect to the specific side 9 and extend in parallel to the antenna patterns 2. The fixing patterns 13 and 14 and the positioning tabs 19 may be produced simultaneously with and in a manner similar to the manner used to produce the antenna patterns 2.

Thereafter, the film member 20 is rolled into a cylindrical shape around a center axis perpendicular to the specific side 9. Opposite ones of the fixing patterns 13 and 14 are soldered to each other to thereby fix the cylindrical shape of the cylindrical body 1. In order to fix the cylindrical shape of the cylindrical body 1, a double-sided adhesive tape may be additionally used in a manner similar to the double-sided adhesive tape use in the helical antenna shown in FIGS. 1 and 2.

With reference to FIG. 7 in addition, the description will be made about the circuit board 3.

The circuit board 3 is a phase shifter substrate having a circuit pattern 4 to serve as a phase-shift circuit. On the circuit board 3, the engaging holes 21 are formed at positions corresponding to the positioning tabs 19 of the cylindrical body 1. The engaging holes 21 are formed into a shape and a size adapted to receive the positioning tabs 19. In the vicinity of each engaging hole 21, a rectangular ground pattern 22 is fixed. The ground pattern 22 is provided with a through hole and connected via the through hole to a ground plane formed on a back surface of the phase shifter substrate. By forming the through hole in the ground pattern 22, it is possible to prevent the ground pattern 22 from being detached.

As depicted by an arrow 23 in FIG. 5, when the cylindrical body 1 is mounted on the circuit board 3, the positioning tabs 19 of the cylindrical body 1 are inserted into the engaging holes 16 of the circuit board 3 to be engaged with edge portions of the engaging holes 16. As a result, the cylindrical body 1 is temporarily fastened to the circuit board 3. Specifically, the cylindrical body 1 is locked or inhibited with respect to rotation around its cylindrical axis as well as movement along the circuit board 3.

In the state where the cylindrical body 1 is temporarily fastened, at least one of the metal member 7 and the positioning tab 19 is soldered to the ground pattern 22 so that the cylindrical body 1 is mechanically connected to the circuit board 3. Simultaneously or approximately simultaneously, the antenna patterns 2 are soldered and electrically connected to a circuit pattern 4 in the manner similar to that explained in conjunction with FIGS. 1 and 2. Thus, the cylindrical body 1 is mounted on the circuit board 3 in a predetermined state. In the mounting operation, the cylindrical body 1 is temporarily fastened to the circuit board 3. It is therefore easy to perform the soldering operation. In addition, it is possible to avoid deterioration in performance due to positioning error.

What is claimed is:

1. A helical antenna comprising:

a cylindrical body formed by an insulating film member which is rolled into a cylindrical shape;

an antenna pattern extending in a helical shape along said cylindrical body;

a circuit board opposite to an axial end of said cylindrical body;

a circuit pattern formed on said circuit board;

a connecting portion connecting said antenna pattern with said circuit pattern by soldering; and a fixed portion fixing said circuit board to a specific part of said cylindrical body;

wherein said specific part is not provided with said antenna pattern; and wherein said fixed portion comprises:

a metal member formed on said specific part;

another metal member formed on said circuit board; and a soldering portion connecting both of said metal members.

2. The helical antenna according to claim 1 wherein said cylindrical body comprises a film connecting portion connecting opposite end portions of said insulating film member in a circumferential direction.

3. The helical antenna according to claim 2, wherein said film connecting portion comprises:

an overlapping portion formed by overlapping said opposite end portions of said insulating film member; and a double-sided adhesive tape inserted in said overlapping portion to adhere said opposite end portions to each other.

4. The helical antenna according to claim 2, wherein, in said film connecting portion, one of (i) said opposite end portions of said insulating film member are connected by soldering and (ii) portions of said insulating film member adjacent to said opposite end portions are connected by soldering.

5. The helical antenna according to claim 1, wherein said insulating film member comprises a specific side facing said circuit board, and said antenna pattern extends obliquely from said specific side.

6. The helical antenna according to claim 5, wherein said insulating film member has a substantially parallelepiped shape with a pair of oblique sides which are inclined with respect to said specific side and extend in parallel to said antenna pattern.

7. The helical antenna according to claim 6, wherein said insulating film member comprises an end portion in a vicinity of each of said pair of oblique sides, and said insulating film member is rolled into a cylindrical shape with said end portions connected to each other so that the cylindrical shape is fixed and maintained.

8. The helical antenna according to claim 7, wherein said end portions are provided with fixing patterns made of metal, and wherein said fixing patterns face each other and are connected by soldering in a condition where said insulating film member is rolled into the cylindrical shape.

9. The helical antenna according to claim 8, wherein said end portions face each other in a radial direction of said cylindrical body and are adhered to each other by a double-sided adhesive tape.

10. The helical antenna according to claim 1, wherein said cylindrical body comprises a positioning tab at said axial end, and said circuit board comprises an engaging hole, and wherein said cylindrical body is temporarily fastened to said circuit board by engagement of said positioning tab and said engaging hole.

11. The helical antenna according to claim 10, wherein said positioning tab comprises a protrusion made of metal and fixedly attached to said insulating film member.

12. The helical antenna according to claim 1, wherein said circuit board comprises a phase shifter substrate comprising a phase-shift circuit.

* * * * *